United States Patent [19]

Pansini

[11] 4,281,995

[45] Aug. 4, 1981

[54] AUTOMATIC POOL CLEANERS

[76] Inventor: Andrew L. Pansini, 180 Los Cerros Dr., Greenbrae, Calif.

[21] Appl. No.: 774,683

[22] Filed: Mar. 7, 1977

Related U.S. Application Data

[63] Continuation of Ser. No. 629,514, Nov. 6, 1975, abandoned, which is a continuation of Ser. No. 386,946, Aug. 9, 1973, abandoned, which is a continuation-in-part of Ser. No. 143,549, May 14, 1971, abandoned.

[51] Int. Cl.[3] ..... B64C 21/06

[52] U.S. Cl. ..... 440/38; 134/167 R

[58] Field of Search ..... 115/11, 12 R; 134/167 R, 168 R, 172; 15/1.7; 4/172.15, 172.16; 210/169

[56] References Cited

U.S. PATENT DOCUMENTS

| | | | |
|---|---|---|---|
| 3,032,044 | 5/1962 | Pansini | 134/168 R |
| 3,170,180 | 2/1965 | Winston et al. | 134/167 R |
| 3,261,371 | 7/1966 | Vernon | 134/168 R |
| 3,265,079 | 8/1966 | Blumenfeld | 134/167 R |
| 3,295,540 | 1/1967 | Ortega | 134/167 R |
| 3,392,738 | 7/1968 | Pansini | 134/167 R |

*Primary Examiner*—Trygve M. Blix
*Assistant Examiner*—Jesus D. Sotelo
*Attorney, Agent, or Firm*—Naylor, Neal & Uilkema

[57] ABSTRACT

A water supply hose has one or more jets operable to maintain that part of the supply hose which is upstream from the jet in tension, the supply hose having its free end supported by a surface float. Another length of hose smaller in diameter extends from the float in line with the larger-diameter water supply hose, the other hose terminating also in a surface float and having a jet disposed adjacent the latter float to maintain the smaller-diameter hose normally under tension. Alternatively, a length of the water supply hose upstream from the first mentioned float may be made of smaller diameter than the balance of the water supply hose and this smaller-diameter portion is then provided with a drive jet adjacent the float adapted to keep the smaller-diameter portion of the hose under tension. The cleaner may be or may not be provided with one or more cleaning hoses.

16 Claims, 9 Drawing Figures

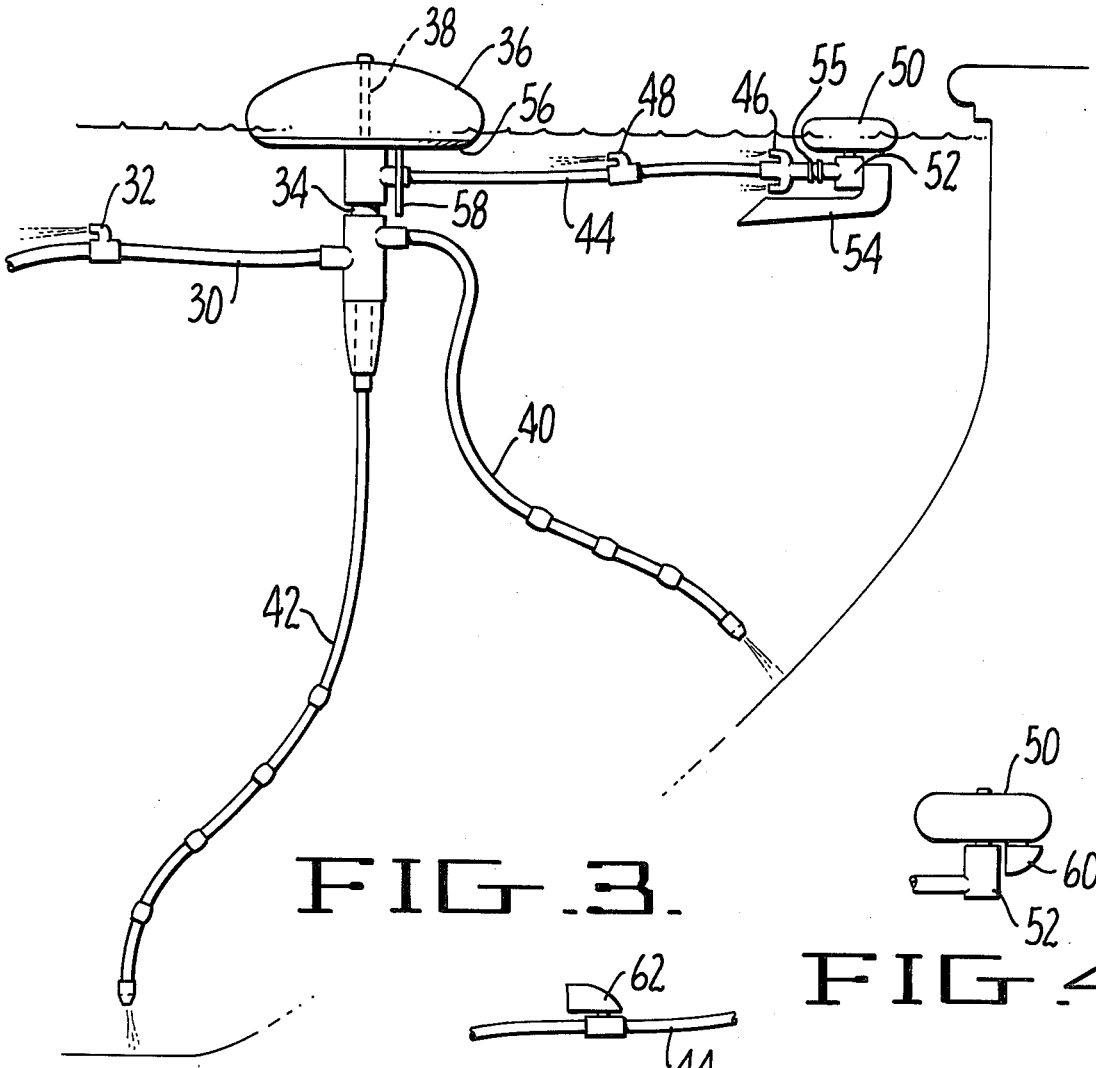
FIG. 3.
FIG. 4
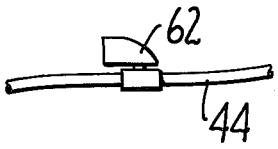
FIG. 5.
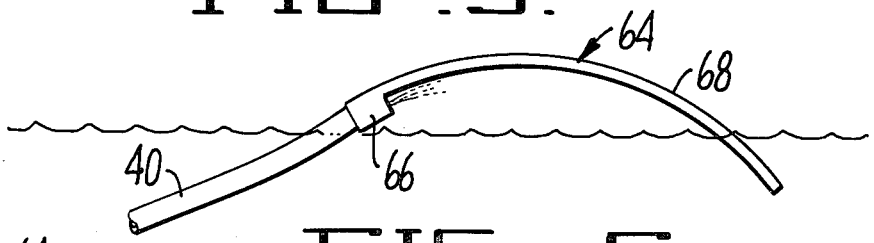
FIG. 6.
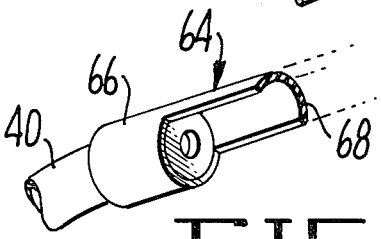
FIG. 7.

AUTOMATIC POOL CLEANERS

RELATED APPLICATIONS

This application is a continuation of my co-pending application, Ser. No. 629,514, filed Nov. 6, 1975 and now abandoned, which in turn was a continuation of my co-pending application, Ser. No. 386,946, filed Aug. 9, 1973 and now abandoned, which in turn was a continuation-in-part of my co-pending application, Ser. No. 143,549, filed May 14, 1971 and now abandoned.

An object of the invention is to provide an automatic pool cleaner which is surface-supported but which has eliminated therefrom any rigid deck arm or the like.

Another object of the invention is to provide an automatic pool cleaner which is able to effect a physical reversal of its direction upon encountering obstructions which normally would cause the cleaner to hang-up without requiring the use of an intermittent water feed system.

Still another object of the invention is to provide an automatic pool cleaner of the surface-supported type which accomplishes the cleaning of the pool wall surfaces without employing either a wall cleaning hose or a floor cleaning hose.

These and other objects and advantages of the invention will be apparent from the following description taken in conjunction with the drawings forming part of this specification, and in which:

FIG. 3 is a similar view of an automatic pool cleaner constituting a further embodiment of the subject invention;

FIG. 4 is a similar view showing a modified form of the lead float disc for the cleaner of FIG. 3;

FIG. 5 is a similar view of auxiliary control rudder means which may be embodied in the lead hose of the cleaner of FIG. 3;

FIG. 6 is a smaller view of the discharge end of one of the pool wall surface cleaning hoses and an attachment connected to the same to prevent the hose from discharging over the deck as it breaks the surface;

FIG. 7 is an enlarged perspective view, partly in section, of the hose and attachment of FIG. 6;

Figure 1:
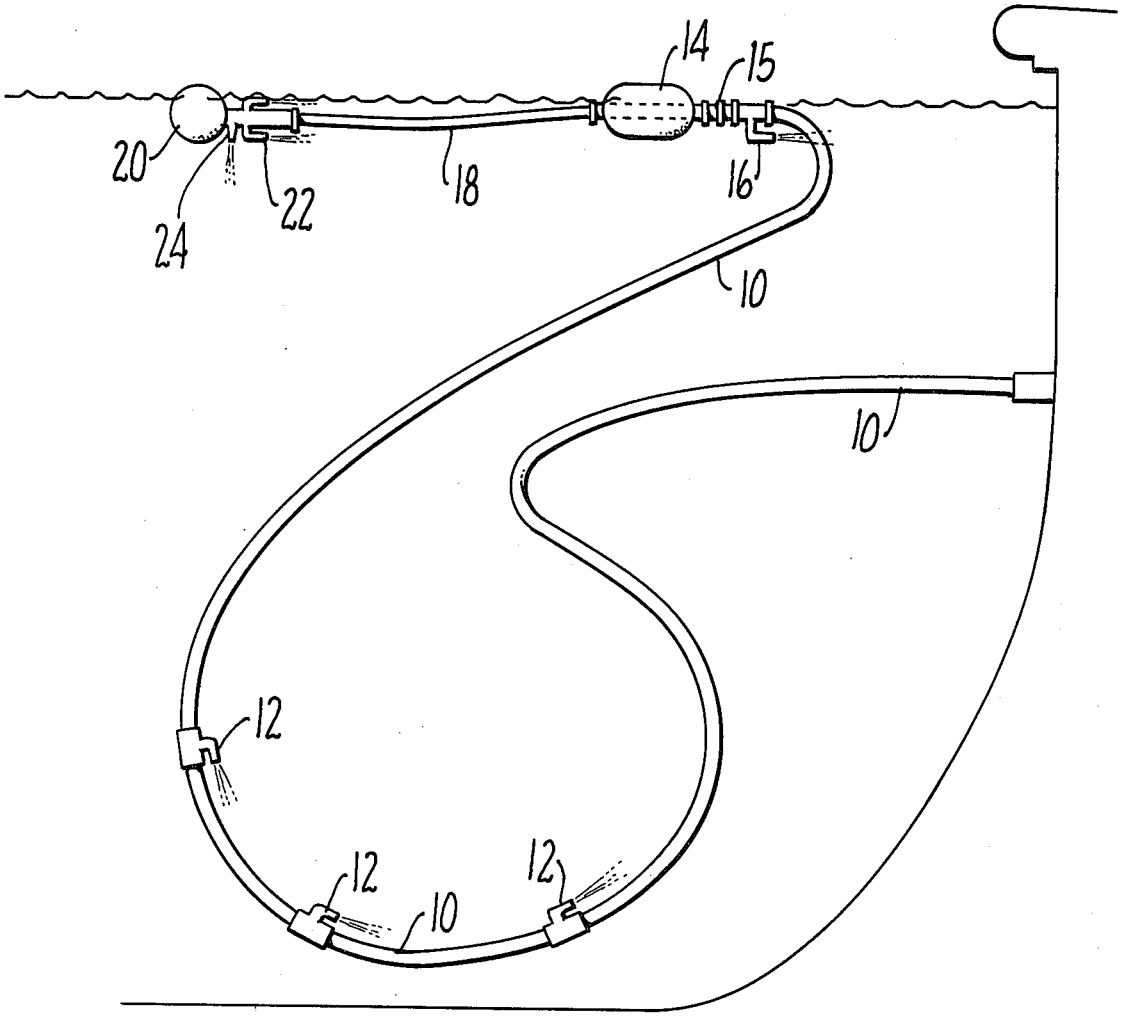
FIG. 1 is a profile view of an automatic pool cleaner of the subject invention.

With reference to FIG. 1, the cleaner comprises water supply hose 10, a plurality of jets 12 adapted to maintain the upstream portions of the supply hose under tension, a surface float 14, a swivel 15, a jet 16 adapted to push the float 14 and tow the supply hose 10, a lead hose 18 of smaller diameter than the supply hose interconnecting the support float 14 and a lead support float 20, a tandem drive jet 22 for the lead hose 18 and a downwardly directed jet 24. The floats 14 and 20, particularly the latter, are preferably round or rounded in planform. It will be noted that the cleaner employs no cleaning hoses as such. Instead, cleaning action is applied to the pool wall surfaces by the jets 12, 16 and 22 and by contact of the supply hose 10 with the pool wall surfaces.

The cleaner of FIG. 1, as is the case with all of the herein disclosed embodiments of the subject invention, is not provided with means, such as a timer and solenoid system, for intermittently turning the water off and on. Such a control is not needed with the cleaners of this invention as they are able to extricate themselves from hang-up positions.

When the surface-borne parts of the cleaner of FIG. 1 are disposed out of engagement with pool wall structure, the paths of discharge of the jets 16 and 22 are normally in alignment. When the lead float 20 meets an obstruction and is blocked or is materially slowed down, drive jet 16 effects compression and bending of lead hose 18, thereby changing the angle of attack of jet 22 relative to the obstruction and causing the float 20 to be freed.

Figure 2:
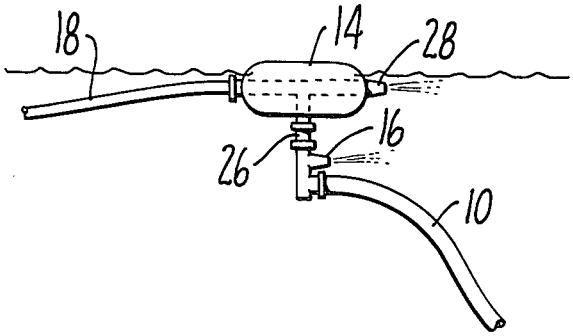
FIG. 2 is a similar view of an alternate float embodiment for the cleaner of FIG. 1.

In the FIG. 2 modification of the cleaner of FIG. 1, the water supply hose is connected to the bottom of float 14 through a vertical swivel 26, and a further jet 28 may be employed to assist the lead hose in freeing itself from an obstruction.

A further embodiment of the cleaner of the invention is shown in FIG. 3. Supply hose 30 having one or more tension jets 32 is connected through a wet swivel 34 with a main support float 36 which is rotatably positioned on a mounting pin 38 to enable the float to rotate when it encounters the pool's side walls. Suspended from the float are a wall cleaning hose 40 and a floor cleaning hose 42. Lead hose 44 having a tendem drive jet 46 and a tension jet 48 extends from the wet swivel 34 to a rotatably mounted lead float 50 which is disc-like in form. The mounting hub 52 for the lead float 50 is provided with a directional fin 54. Between jet 46 and hub 52 a dry swivel 55 is provided. Depending from the float support plate 56 which is fixedly attached to the upper part of the swivel 34 is a baffle 58 which may be provided to tend to slow down movement of float 36 relative to the movement of float 50, thereby causing lead hose 44 to be normally in a stretched towing condition with respect to the float 36.

It will be appreciated that the cleaner of FIG. 3 extricates itself from obstructions encountered by the lead float 50 in substantially the same manner as that described for the cleaner of FIG. 1. In both instances the lead float serves as a light, maneuverable advance scout for the main support float, a function of the lead float being to get into and out of trouble and, in the getting out, to tow the main float away from trouble before it can encounter it.

In the modification of FIG. 4 of the float 50 of FIG. 3, a directional fin 60 is affixed directly to the float rather than being carried by the hub 52. Thus, as the float 50 encounters an obstructing surface and is caused to rotate, the fin 60 likewise turns and enhances a freeing movement of the float in a new direction.

As shown in FIG. 5, the lead hose 44 may likewise be provided with a directional fin 62.

From time to time the wall cleaning hose 40 will break the water surface and discharge a stream of water over the pool deck. To prevent this, the discharge end of the wall cleaning hose is provided with a flexible deflector 64 comprising a sleeve portion 66 and a semi-round elongated portion 68. When the deflector 64 is submerged it assumes a straight trailing attitude with respect to the hose 40, thereby not interfering with the wall cleaning function of the discharge jet. As the deflector surfaces, as shown in FIG. 6, it readily flexes to redirect the discharging jet back into the pool.

Figure 8:
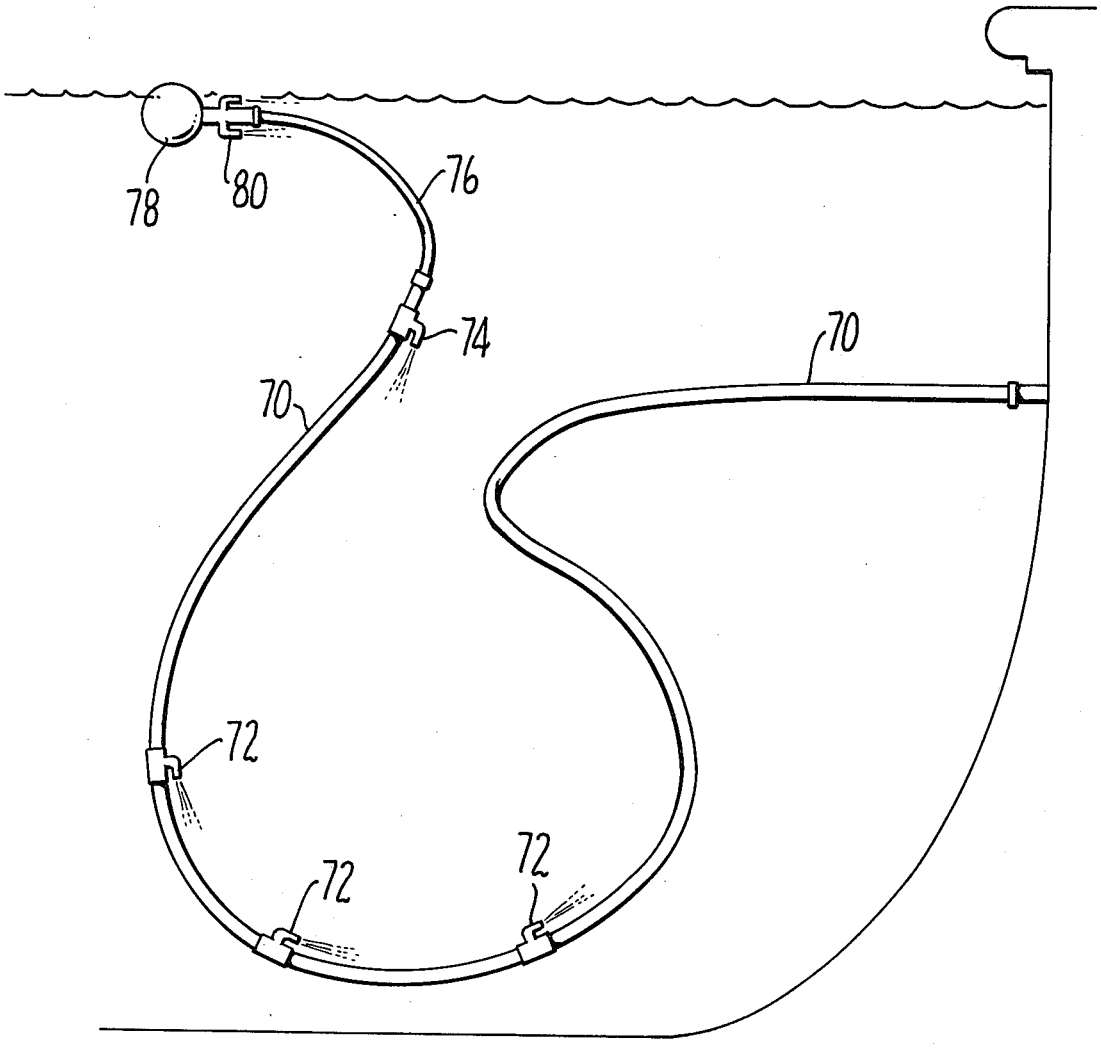
FIG. 8 is a view similar to FIG. 1 of an automatic pool cleaner constituting a further embodiment of the subject invention.

The embodiment of the invention shown in FIG. 8 comprises water supply hose 70, tension jets 72, drive jet 74, lead hose 76, float 78 and a tandem drive jet 80 for the float 78. This embodiment differs essentially from that of FIG. 1 in that the main support float 14 of the latter has been eliminated. The manner of extrication of float 78 from obstructions is essentially the same as that previously described in connection with FIG. 1.

Referring again to FIG. 1, it is pointed out that two forms of surfacing members are shown, i.e. the float type 20 and the propulsion type 24. Either or both types may be used to dispose selected parts of the cleaner on the pool surface. If the propulsion type is used to the exclusion of the float type, the cleaner would sink to the bottom of the pool when the water to the supply hose was turned off and would thereafter rise to the surface of the pool when the water was turned on. In the absence of floats 14 and 20 the natural resistance of the lead hose 18 to axial twisting would be sufficient, once the water flow has been re-commenced, to orient the direction of jet 24 essentially downwardly. In this process of sinking followed by rising the cleaner of course can be disengaged from a position or condition in which it has been rendered immobile at the pool surface. The expression "surfacing member" is intended to describe one or the other or both of the float and propulsion type of water-actuated surfacing means.

Figure 9:
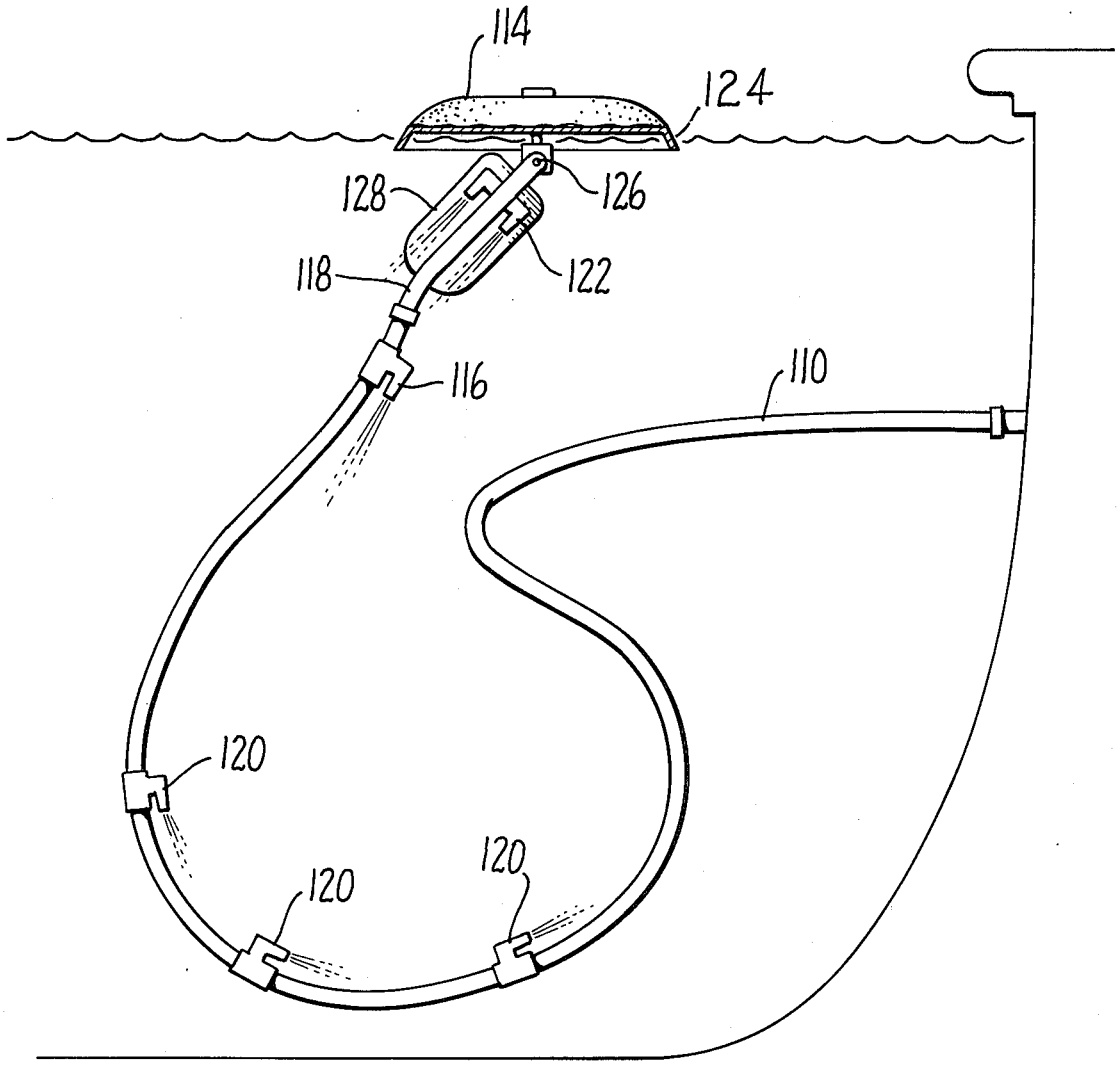
FIG. 9 is a view similar to FIG. 1 of an automatic pool cleaner constituting still a further embodiment of the subject invention.

In FIG. 9, the cleaner comprises water supply hose 110, jets 120 adapted to maintain the upstream portions of the supply hose under tension, a surfacing member 114, a jet 116 adapted to push the surfacing member 114 and tow the supply hose 110, a lead hose 118 of greater flexibility than the supply hose 110 interconnecting the latter and the surfacing member 114, and a tandem drive jet 122 for the lead hose 118. The surfacing member 114 is provided with an outwardly angled skirt member 124 adapted to slow down the movement of the surfacing member. The drive jet set 122 is adapted to swivel around the axis of the lead hose 118 and is adapted to swing about the horizontal pivot axis 126. Thus the jet tandem swivels on both a vertical axis and a horizontal axis like a universal joint. The same effect could be achieved by replacing this universal-like joint arrangement with a short length of very flexible hose, i.e., so that the jet tandem 122 could assume almost any position beneath the surfacing member 114. The jet tandem 122 is provided with a blade 128 which is attached to it to prevent excessive spinning of the hose about the surfacing member 114. The blade 128 may of course be attached to the swivel hub to which the jet tandem 122 is attached.

The cleaner of FIG. 9 travels very desirably and slowly and is adapted not to get stuck or immobilized by pool steps, etc. As long as the transporter jet 116 is strong enough, the surfacing member moves to one side or another even when the transporter jet is hanging straight down, as is approximately the case in FIG. 9. As the surfacing member 114 approaches the pool steps, the jet is dragged into a horizontal plane whereby greater power is available to get the unit off of the steps.

The lead hose may be provided with a rotor blade which is swivel-mounted and adapted to rotate about the axis of the lead hose whereby the lead end of the cleaner is inhibited against a tendency to run in circles. The operational function of such a rotor blade would be to rotate the lead hose into a new arc position.

What is claimed is:

1. A swimming pool cleaner comprising a flexible water supply hose having a fixed end and a free end, a surfacing member attached to the hose, means to drive the surfacing member about a pool comprising a jet means carried by the hose adjacent the member adapted to place the upstream part of the supply hose under tension, and pool wall cleaning means comprising a plurality of separate, spaced jet means mounted directly on the hose intermediate the ends thereof operable to constantly discharge jet streams substantially axially of said hose and thereby apply tension forces to respective upstream portions of the hose and, when said surfacing member is obstructed, to apply a compression force to the supply hose portion between said first mentioned and second mentioned jet means and thereby bend said supply hose portion and re-direct said first mentioned jet means to move said surfacing member in another direction.

2. A swimming pool cleaner comprising a main surfacing member, a flexible water supply hose attached to the member, a drive jet for the supply hose adjacent the member, a flexible lead hose attached to the member and connected to the supply hose, a lead surfacing member carried by the distal end of the lead hose, and a drive jet for the lead surfacing member and lead hose for driving the lead surfacing member and the distal end of the lead hose with respect to the main surfacing member whereby said drive jet will apply a tension force to the lead hose.

3. A swimming pool cleaner comprising a manifold, including a swivel, having a pair of parts, an upper one and a lower one, rotatable about a vertical axis, a surfacing member supporting the manifold, a short, flexible lead hose, provided with a drive jet, connected to the upper part of said manifold, and a flexible water supply hose, provided with an axially directed drive jet, connected to the lower part of said manifold.

4. A swimming pool cleaner comprising a flexible water supply hose, a first surfacing member supporting the downstream end thereof, a short, flexible lead hose connected in flow receiving relation to the downstream end of the supply hose, a second surfacing member supporting the distal end of the lead hose, first jet means connected to the supply hose adjacent said first surfacing member, adapted to place the upstream part of the supply hose under tension, second jet means, connected to the lead hose adjacent said second surfacing member, adapted to place the upstream part of the lead hose under tension, whereby, when the second surfacing member is constrained against movement by an obstruction, the lead hose is caused to bend under the action of said first jet means to thereby redirect said second jet means to move said second surfacing member past said obstruction.

5. A swimming pool cleaner comprising a flexible water supply hose, a water-powered transporter connected to the supply hose adjacent the distal end of said hose and operable to place said distal end under tension, and water-powered drive means for the supply hose, said means being located upstream from said transporter, said means serving to place the supply hose portion upstream therefrom constantly under tension, and said means being operable, in the event said transporter is blocked, to tend to drive the upstream hose portion past the downstream hose portion, thereby changing the direction of movement of said transporter and unblocking the same.

6. A swimming pool cleaner comprising a flexible water supply hose having a fixed end and a free or distal end, water supply means attached to the fixed end, and water discharge transporter means attached to the distal end operable to move horizontally and vertically through the pool water and to tow the supply hose accordingly.

7. A swimming pool cleaner comprising a flexible water supply hose having a fixed end and a free or distal end, water supply means attached to the fixed end, and non-buoyant water discharge transporter means attached to the distal end operable in response to the discharge of water from the free end of said hose to cause the distal end to move horizontally and vertically through the pool water and to tow the supply hose accordingly.

8. The cleaner of claim 7, said transporter means being operable to sink toward the bottom of the pool upon the cessation of discharge of water from the free end of said hose.

9. The cleaner of claim 7 including propulsion means carried by the supply hose and operable to push said transporter means through the medium of the intervening portion of said supply hose.

10. A swimming pool cleaner comprising a flexible water supply hose having a fixed end and a free end, a water-powered non-buoyant surfacing member attached to the hose, said member being adapted to sink toward the floor of the pool upon cessation of water flow through said hose and to arise from the floor upon the resumption of water flow through said hose.

11. The cleaner of claim 10 including propulsive means operable to push the surfacing member about the pool.

12. A swimming pool cleaner comprising a flexible water supply hose having a fixed end and a free end, a surfacing member attached to the free end, jet means to drive the surfacing member and place the upstream part of the supply hose under tension, a plurality of spaced apart propulsion and cleaning jets carried directly by the hose in non-pendent relation thereto, the leading one of said jets placing an upstream section of the supply hose immediately adjacent thereto constantly under tension and, when said surfacing member is obstructed, applying a compression force to the supply hose portion between said jet means and said leading jet to thereby bend said supply hose portion and redirect said jet means to move said surfacing member in another direction, the next succeeding jet in the upstream direction placing an upstream section of the supply hose immediately adjacent thereto also constantly under tension.

13. A swimming pool cleaner comprising a flexible water supply hose having a fixed end and a free end, a surfacing member attached to the free end adapted to sink and rise in the pool when, respectively, water flow in the supply hose is turned off and turned on, downwardly directed jet means attached to said member adapted to cause the member to approach the surface of the pool as water is discharged therefrom, and water-powered means associated with said member to horizontally transport said member within the pool.

14. A swimming pool cleaner comprising a flexible water supply hose having a fixed end and a free end, non-buoyant propulsion means operable to cause the free end to surface, and means to drive the free end about a pool comprising jet means carried by the hose and oriented to be substantially parallel to the axis thereof.

15. The cleaner of claim 14, said jet means being located along said hose in upstream relation to the free end thereof and to said propulsion means.

16. A swimming pool cleaner comprising a flexible water supply hose having a fixed end and a free end, a surfacing member attached to the free end, first jet propulsion means for said member free to direct a first jet in all lines of direction from a location under the member, second jet propulsion means in flow communication with the first jet propulsion means and spaced apart therefrom in upstream relation thereto, operable in response to constraint of movement of said member by an obstruction to constantly apply a compressive force to that portion of the supply hose disposed between said first and second jet propulsion means and thereby bend said hose portion and re-direct said first jet along another of said lines of direction.

* * * * *